US007946856B2

(12) United States Patent
Jaeger

(10) Patent No.: US 7,946,856 B2
(45) Date of Patent: May 24, 2011

(54) CONNECTOR FOR INTERCONNECTING SURFACE-MOUNT DEVICES AND CIRCUIT SUBSTRATES

(75) Inventor: Peter Dirk Jaeger, Dussen (NL)

(73) Assignee: Tyco Electronics Nederland BV, S-Hertogenbosch (NL)

( * ) Notice: Subject to any disclaimer, the term of this patent is extended or adjusted under 35 U.S.C. 154(b) by 0 days.

(21) Appl. No.: 12/640,902

(22) Filed: Dec. 17, 2009

(65) Prior Publication Data

US 2010/0159716 A1 Jun. 24, 2010

Related U.S. Application Data

(63) Continuation of application No. PCT/EP2008/004686, filed on Jun. 11, 2008.

(30) Foreign Application Priority Data

Jun. 18, 2007 (EP) ..... 07011877

(51) Int. Cl.
*H01R 12/00* (2006.01)

(52) U.S. Cl. ..... 439/66

(58) Field of Classification Search ..... 439/66–74, 439/91, 591

See application file for complete search history.

(56) References Cited

U.S. PATENT DOCUMENTS

| | | | | |
|---|---|---|---|---|
| 5,061,192 | A * | 10/1991 | Chapin et al. | 439/66 |
| 5,259,770 | A * | 11/1993 | Bates et al. | 439/66 |
| 6,344,401 | B1 * | 2/2002 | Lam | 438/460 |
| 6,409,521 | B1 * | 6/2002 | Rathburn | 439/66 |
| 6,948,946 | B1 * | 9/2005 | Ju | 439/71 |
| 7,192,320 | B2 | 3/2007 | Yasumura et al. | |
| 7,329,129 | B2 * | 2/2008 | Soeta | 439/66 |
| 7,568,917 | B1 * | 8/2009 | Malstrom et al. | 439/66 |
| 7,604,486 | B2 * | 10/2009 | Martinson et al. | 439/70 |
| 2001/0027034 | A1 * | 10/2001 | Eskildsen et al. | 439/71 |
| 2005/0208791 | A1 * | 9/2005 | Xie et al. | 439/70 |
| 2007/0042591 | A1 * | 2/2007 | Hummler | 438/612 |
| 2008/0227307 | A1 * | 9/2008 | Alden et al. | 439/66 |
| 2010/0058580 | A1 * | 3/2010 | Yazdani | 29/740 |

FOREIGN PATENT DOCUMENTS

| | | | |
|---|---|---|---|
| CH | 608926 | A5 | 1/1979 |
| DE | 2651186 | A1 | 5/1978 |
| DE | 4128261 | A1 | 3/1992 |
| GB | 202006003525 | U1 | 5/2006 |

OTHER PUBLICATIONS

International Search Report for PCT/EP2008/004686, dated Sep. 23, 2008, 3 pages.

International Preliminary Report on Patentability for co-pending International Application No. PCT/EP2008/004686, dated Jan. 7, 2010, 8 pages.

* cited by examiner

*Primary Examiner* — Briggitte R Hammond
*Assistant Examiner* — Larisa Z Tsukerman
(74) *Attorney, Agent, or Firm* — Barley Snyder LLC

(57) ABSTRACT

The invention relates to a connector for electrically connecting at least one terminal arranged on a surface of a surface-mount device to a corresponding substrate contact of a circuit substrate. The connector for electrically includes at least one resilient electrically conductive interconnection element being connectable to the at least one substrate contact and configured to establish a releasable electrical contact with the at least one terminal, and a connector housing for mounting the at least one interconnection element. The interconnection element is affixed to the housing by means of a foil-shaped carrier.

24 Claims, 10 Drawing Sheets

CONNECTOR FOR INTERCONNECTING SURFACE-MOUNT DEVICES AND CIRCUIT SUBSTRATES

CROSS-REFERENCE TO RELATED APPLICATIONS

This application is a continuation of PCT International Application No. PCT/EP2008/004686, filed Jun. 11, 2008, which claims priority under 35 U.S.C. §119 to European Patent Application No. EP 07011877.3, filed Jun. 18, 2007.

FIELD OF THE INVENTION

The invention relates to an electrical connector, and more particularly to a connector for electrically connecting at least one terminal arranged on a surface-mount device to a corresponding contact of a circuit substrate.

BACKGROUND

Common printed circuit board (PCB) construction today uses surface-mount technology (SMT) for mounting surface-mount devices (SMD) to circuit substrates. In SMT, conductive pads are placed on the surface of a printed circuit board, and solder paste is screened onto the pads. A machine then places one or more of the SMT components in their respectively correct places on the PCB, with the terminals of the SMD, in contact with the solder paste, which is usually slightly adhesive. The PCB assembly is then placed in a solder reflow oven, which heats the PCB and the components to a temperature where the solder paste reflows, forming thereby permanent electrical connections between the terminals of the components and the pads of the PCB.

It is this then necessary to remove the excess solder paste, which contains corrosive flux materials, which prevents corrosion of the PCB assembly over time. This process is usually carried out by immersing the PCB assembly in a liquid solder flux removal agent, which is usually water-based.

During the reflow process, the printed circuit board, including integrated circuits, reaches peak temperatures of about 260° C. This hot process step results in a high percentage of the integrated circuits becoming defective, since they are exposed to such high temperatures. One defective integrated circuit on the printed circuit board may result in required rework, or scrapping the complete electronic module. This is in particular a significant drawback for memory modules.

Furthermore, in the course of recent environmental regulations, established soldering processes are being reassessed due to restrictions regarding the use of lead in the soldering process.

It is known to use so-called metallized particle interconnects (MPI), in order to provide an interconnect method for high density board components without using metal pins or solder. The MPI material is formed into tiny micro-columns that align with the contacts of the packaged device and the landing pad contacts of the printed circuit board. When mechanically compressed by a frame holding the integrated circuit, the metallized particles inside the compressed columns join to form a conductive path between the contacts. U.S. Pat. No. 6,325,552, for instance, shows the use of a solderless interconnect for an optical transceiver.

On the other hand, it is known to provide an interconnection device, which has a non-conductive carrier housing and resilient C-shaped interconnecting elements. The interconnection device establishes an electric contact by being disposed between the two components that are to be electrically connected and being subject to a compressing force. An example for such an interconnection device is shown in U.S. Pat. No. 7,186,119 B2.

However, these known interconnecting devices suffer from the disadvantage that their construction is rather time-consuming and costly.

SUMMARY

An object of the invention, among others, is to provide a connector for electrically connecting at least one terminal of a surface-mount device to a corresponding substrate contact of a circuit substrate that can be fabricated in a particularly simple and cost-effective manner, while at the same time allow for a reliable electrical contact of surface-mount devices in particular when having extremely small pitch dimensions.

The connector, for electrically connecting a surface-mount device to a circuit substrate, includes at least one resilient interconnection element, with the interconnection element being connectable with at least one substrate contact and configured to establish a releasable electrical contact with at least one terminal of the surface-mount device. The connector further includes a connector housing for mounting the at least one interconnection element and a foil-shaped carrier for connecting the interconnection element to the housing.

BRIEF DESCRIPTION OF THE DRAWINGS

Embodiments of the invention are described in greater detail in the following description and are shown in a simplified manner in the drawings, in which.

DETAILED DESCRIPTION OF THE EMBODIMENT(S)

For an improved understanding of the invention, it will now be described in more detail with the aid of the embodiments shown in the following figures.

Figure 1:
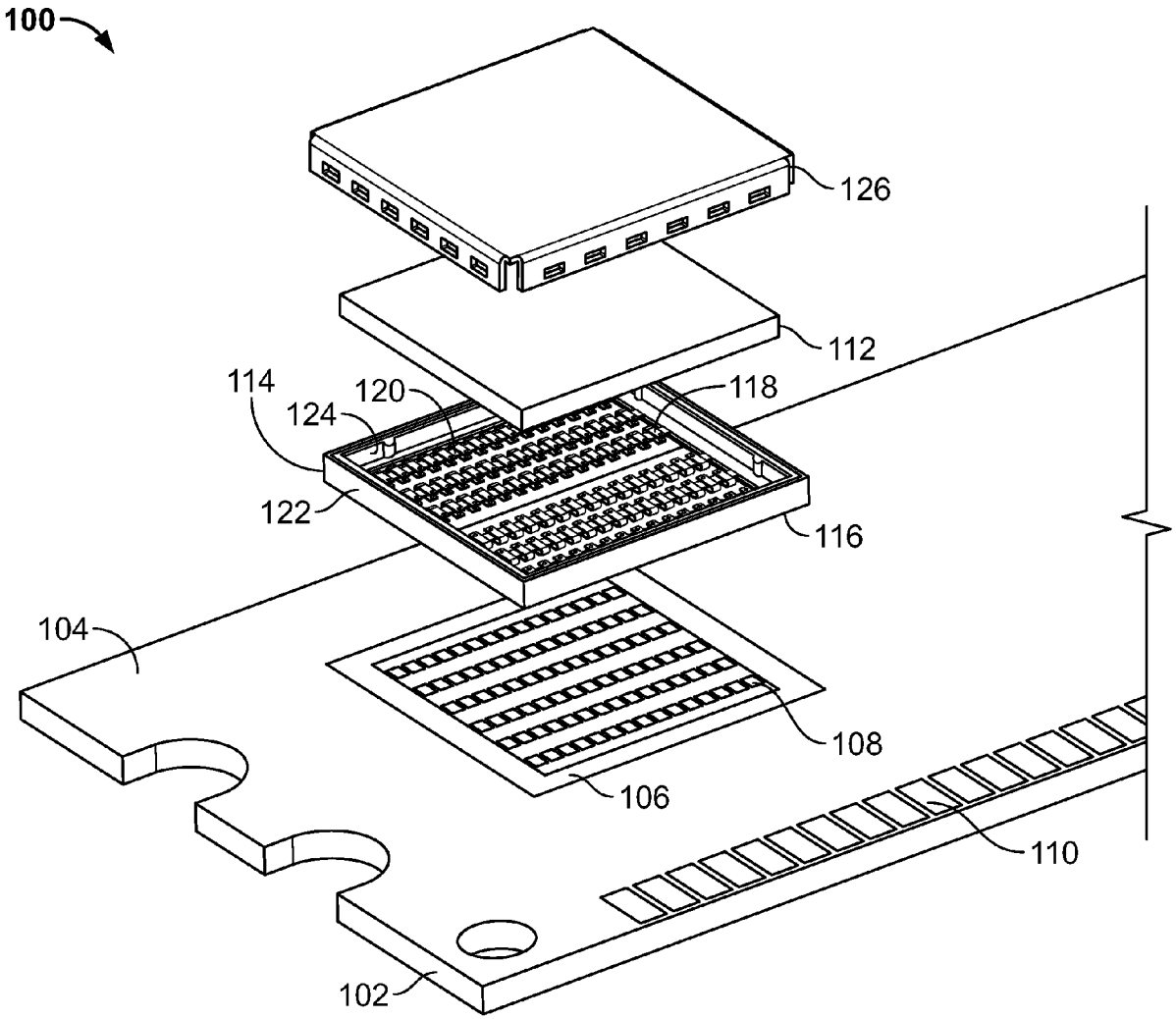
FIG. 1 is an exploded perspective view of a part of an electronic module having a connector according to the present invention.
Figure 2:
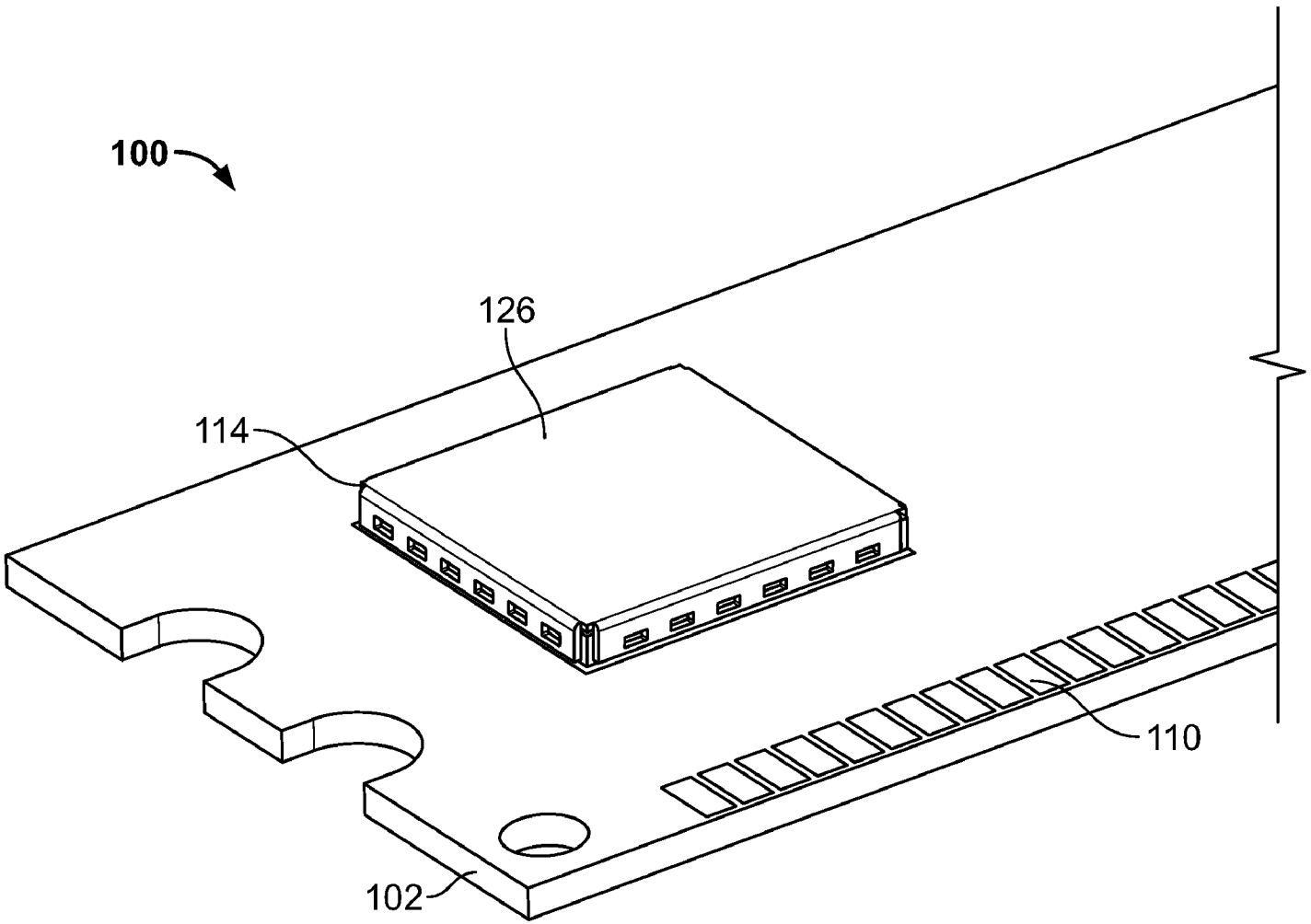
FIG. 2 shows the electronic module having the connector of FIG. 1 in a mounted state.

As shown in FIG. 1, an electronic module 100 includes a circuit substrate 102, which is a printed circuit board (PCB) in the embodiment shown, and is further represented, for exemplary purposes, as a memory module mounted on a DIMM 184 Pin DDR 1.27 CLXX-1, according to JEDEC JC11.

As is generally known, printed circuit boards can consist of a variety of materials, such as paper PCB substrates, fiberglass PCB substrates, RF-substrates comprising low dielectric plastics, flexible PCB substrates or ceramic/metal core substrates. All these materials can be adapted for use with a connector 114, according to the present invention.

As can be seen in FIG. 1, on a first surface 104 of the circuit substrate 102 (PCB), a solder area 106 and a contact surface are provided. The contact surface consists of a plurality of substrate contacts 108, often referred to as "pads" that are connected to outward terminals 110 via internal leads (not shown in this figure). Each of the substrate contacts 108 corresponds to a terminal 130 of the surface-mount device (SMD) 112 (see FIG. 113).

According to the present invention, the SMD 112 is connected to the substrate contacts 108 through the connector 114. This connector 114 consists of a frame 116 carrying a plurality of resilient electrically conductive interconnection elements 118. The interconnection elements 118 are mounted on a foil-shaped carrier 120 (as will be explained in more detail with respect to FIG. 7).

Figure 7:
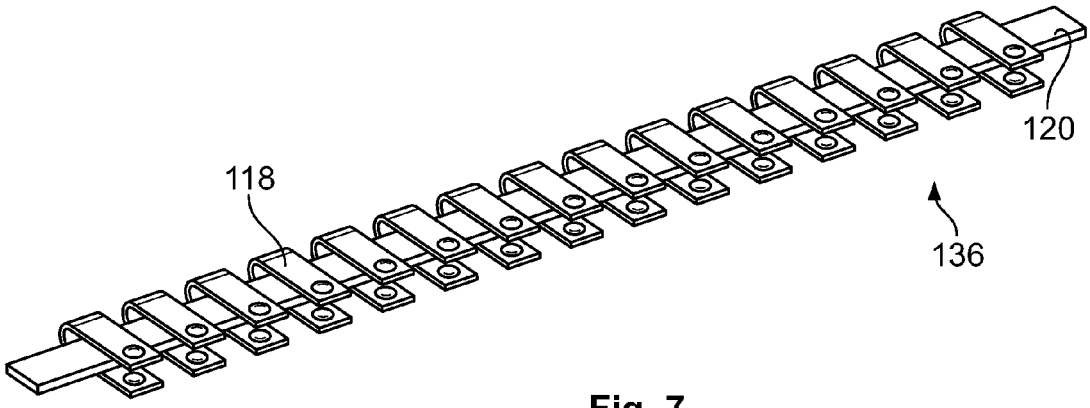
FIG. 7 is a perspective view of a foil-shaped carrier of the connector, according to the invention.
Figure 8:
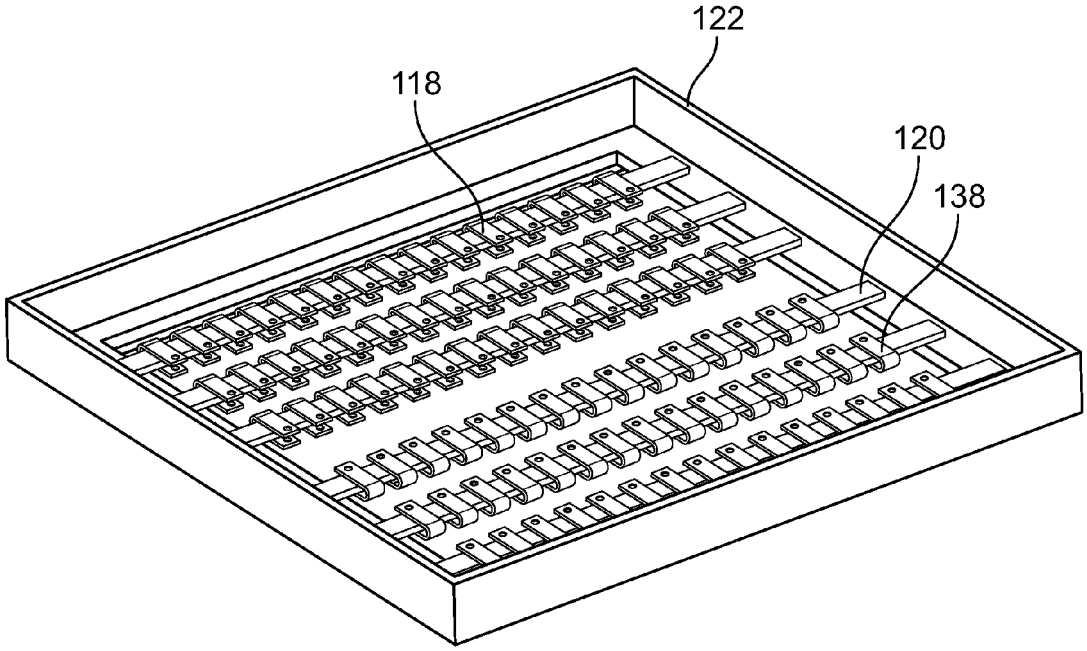
FIG. 8 is a perspective view of a metal base forming part of a connector frame for the connector, according to the invention.
Figure 9:
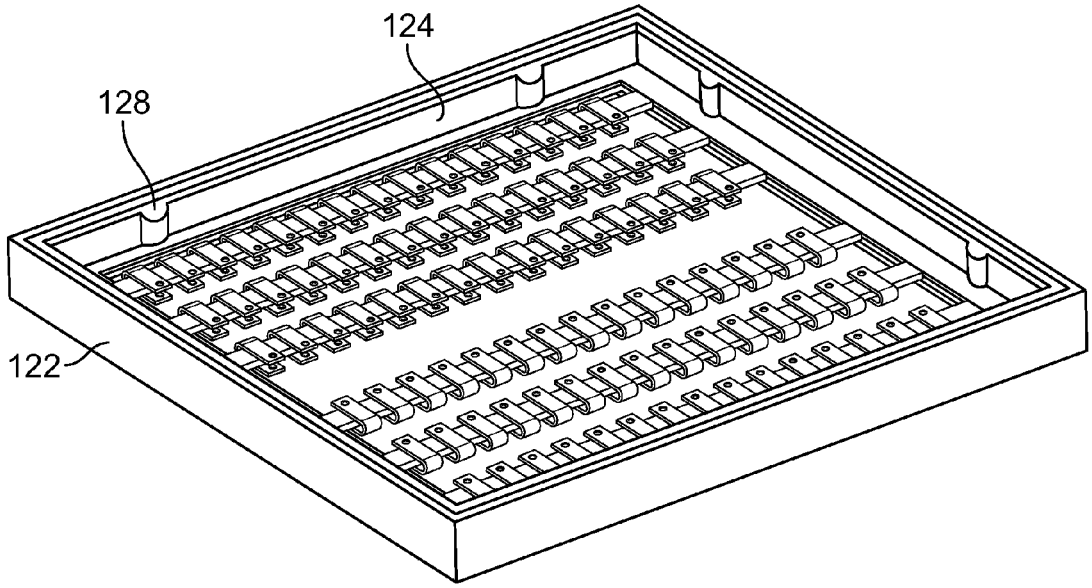
FIG. 9 is a perspective view of the frame of FIG. 8 after molding carriers to the metal base.

In the embodiment shown, identical contact strip 136 is prepared from a plurality (i.e. fifteen) of interconnection elements 118 mounted to a band structured carrier 120 (see FIGS. 7 and 8). Identical contact strips 136 are mounted within the frame 116 to produce the interconnection element 118 array shown in FIG. 1. Six identical contact strips 136 are used to produce the interconnection element 118 array in the embodiment shown. Each of the carriers 120 of the contact strip 136 is fixed to a metal base 122 by means of an overmold 124. This configuration forms the frame 116.

According to the exemplary embodiment, the array of interconnection elements 118 directly mirrors the array structure of the substrate contacts 108 into an identical pattern on the lower surface of the SMD 112. However, this is not necessarily the case. By structuring the C-shaped interconnection elements 118 in a less symmetrical way, a redistribution of the array structure present on the SMD 112 is feasible with respect to the circuit substrate 102.

For fixing the connector 114 to the circuit substrate 102 (PCB), the metal base 122 can be soldered to the solder area 106. The electrical connection between the interconnection elements 118 and the substrate contacts 108 can be established by compression contact or, alternatively, by a solder contact.

The plastic overmold 124 is shaped in a way that it allows an alignment of the SMD 112 with respect to the interconnection elements 118.

According to the present invention, the connector 114 is soldered to the circuit substrate 102 (PCB) and after that, no further high temperature step is required. The SMD 112 is aligned within the frame 116 and a cover 126 is attached for mechanically securing the SMD 112 on the substrate contacts 108 applying thereby the necessary compression in z-direction. The cover 126, in the embodiment shown, is prepared from metal, and therefore, can serve as a heat spreader and an electromagnetic shielding at the same time. The SMD 112, according to the shown embodiment, is formed by a silicon die and an additional redistribution layer (RDL).

This RDL can consist either of a single layer or also of a multitude of layers providing a copper trace within dielectric layers. The redistribution layer allows the contact terminals, which are arranged on the silicon die only in marginal positions to be distributed evenly over the whole lower surface.

Figure 3:
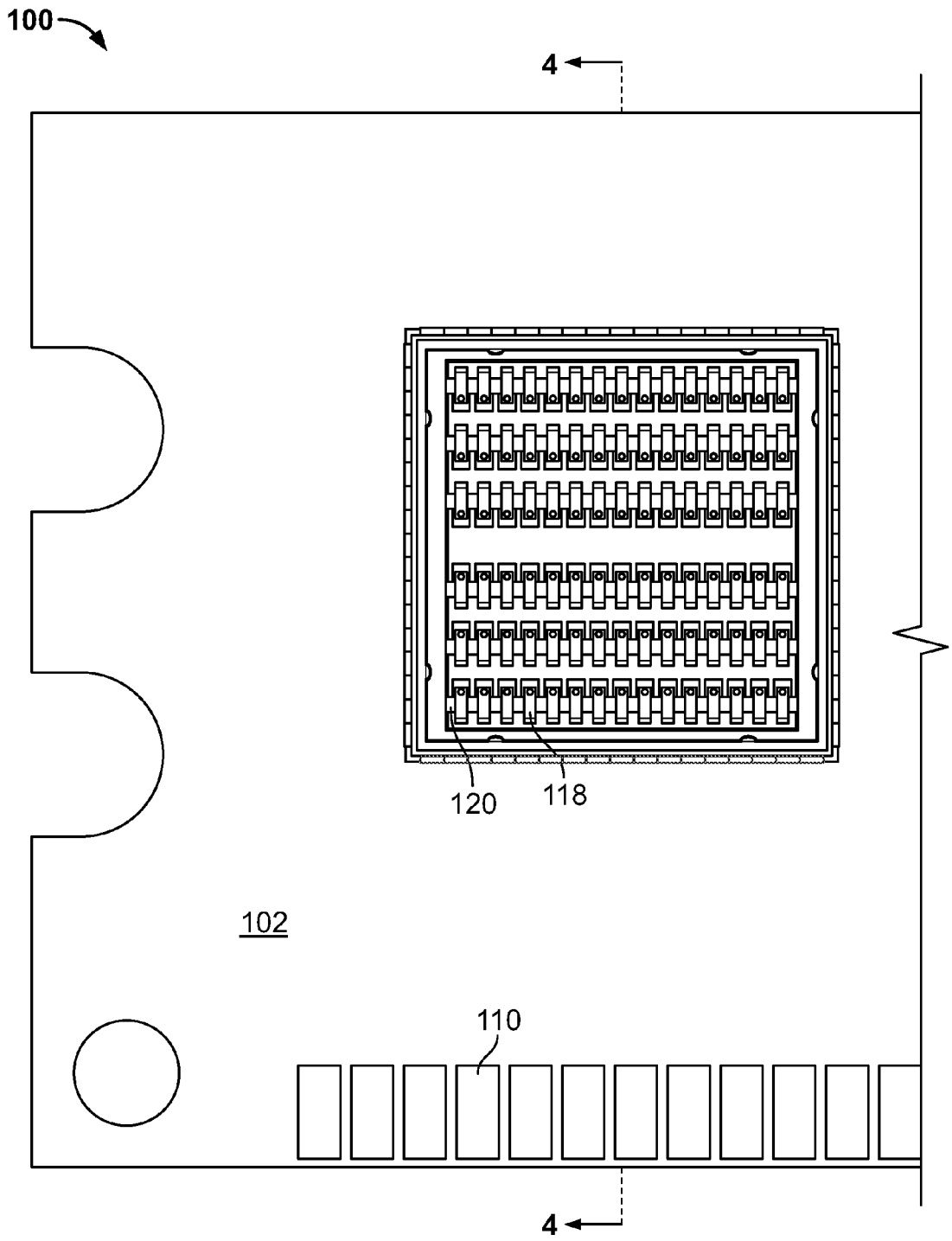
FIG. 3 is a top view of the electronic module having the connector of FIG. 2.
Figure 10:
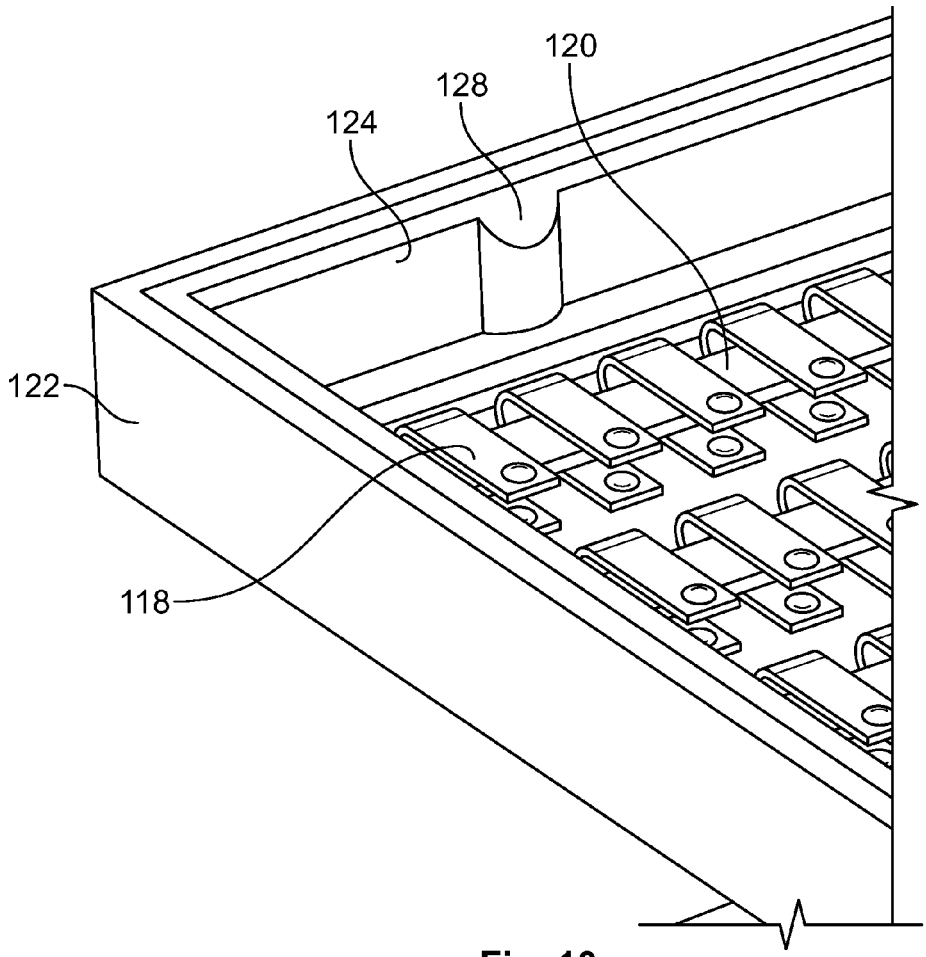
FIG. 10 is a detailed perspective view of FIG. 9.

With reference to FIGS. 3 and 10, alignment structures 128 can be seen, which position the SMD 112 with respect to the interconnection elements 118.

Figure 4:
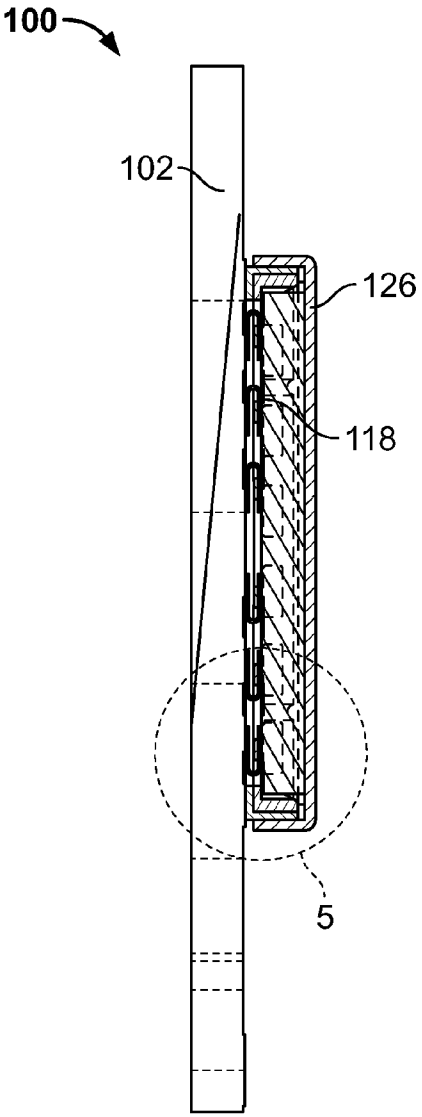
FIG. 4 is a sectional view of the electronic module having the connector shown in FIG. 3, along section line 4-4 of FIG. 3.

As may be derived from FIG. 4, the silicon die is completely encompassed by the housing (formed by the frame 116 and the compression cover 126) to be mechanically protected and electromagnetically shielded. Further, since the silicon chip is in contact over the whole surface with the compression cover 126, the compression cover 126 also works as a heat spreader to dissipate heat from the chip.

Figure 5:
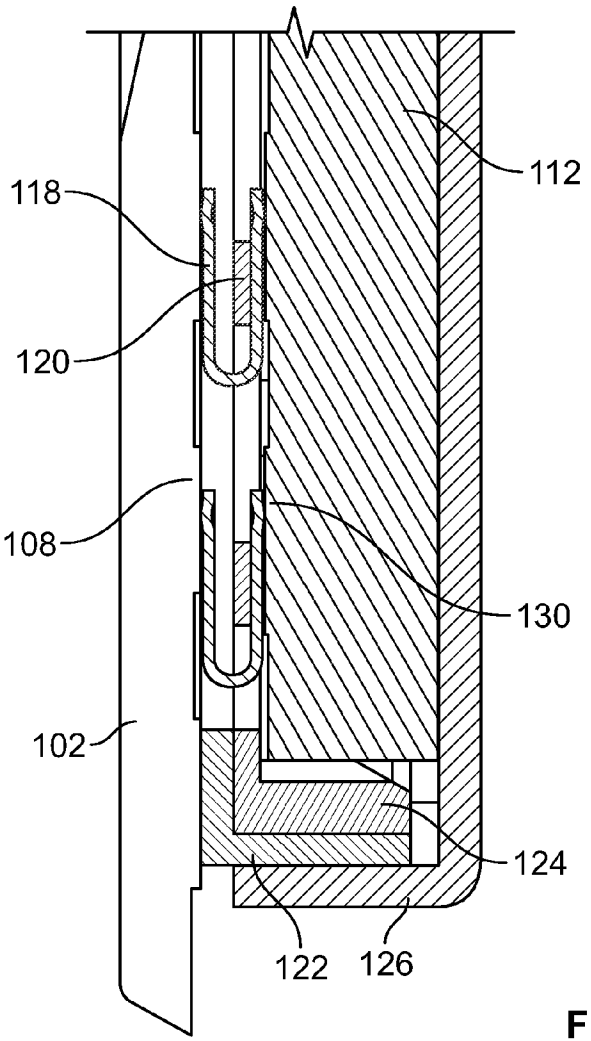
FIG. 5 is a close-up sectional view of the electronic module of FIG. 4.

As shown in FIG. 5, the functioning of the interconnection elements 118 is visible. By pressing down the SMD 112, the compression cover 126 presses the U-shaped interconnection elements 118 with one contact region to the terminals 130 provided at the SMD 112 and with a second contact region to the substrate contact 108.

Figure 6:
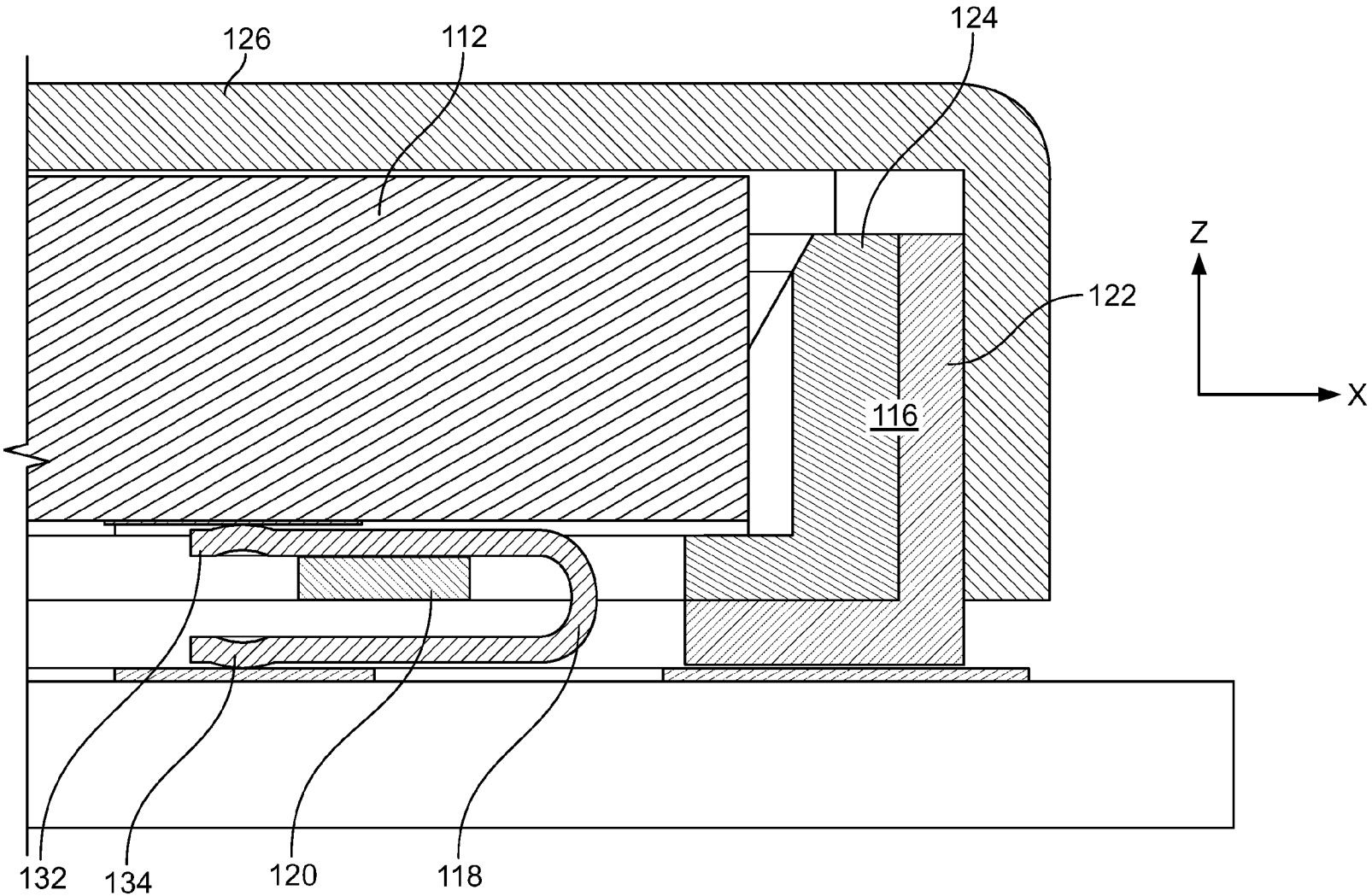
FIG. 6 is a detailed sectional view of the electronic module of FIG. 5.

As shown in FIG. 6, the shape of the interconnection elements 118 is visible. Each of the interconnection elements 118 consists of a U-shaped stamped and bent contact element having contact regions 132 and 134 arranged at the legs of the U-shape. Being fabricated from a spring-type material, the U-shaped form of the interconnection elements 118 ensures resilience in a direction.

According to the present invention, each of the interconnection elements 118 are attached to a foil-shaped carrier 120, thus being suspended within the frame 116. This allows for a very reproducible contact force only being determined by the spring characteristics of the interconnection elements 118.

With respect to the FIGS. 7 to 10, the fabrication of a connector 114, according to the present invention will now be explained.

Firstly, a contact strip 136 is formed by attaching a plurality of interconnection elements 118 to a foil-shaped carrier 120. This carrier can consist of all commonly used materials, for instance, laminate foils. Preferably, the material has some flexibility in order to allow for an adjustment of mechanical stress.

As shown in FIG. 8, a plurality of these contact strips 136, six in the shown embodiment, are arranged in the metal base 122 and secured, for instance, by welding spots or an adhesive in the end regions 138. In the next step, the overmold 124 is applied, fixing the contact strips 136 and providing alignment structures 128 for exactly positioning the SMD 112 (see FIG. 9).

Figure 11:
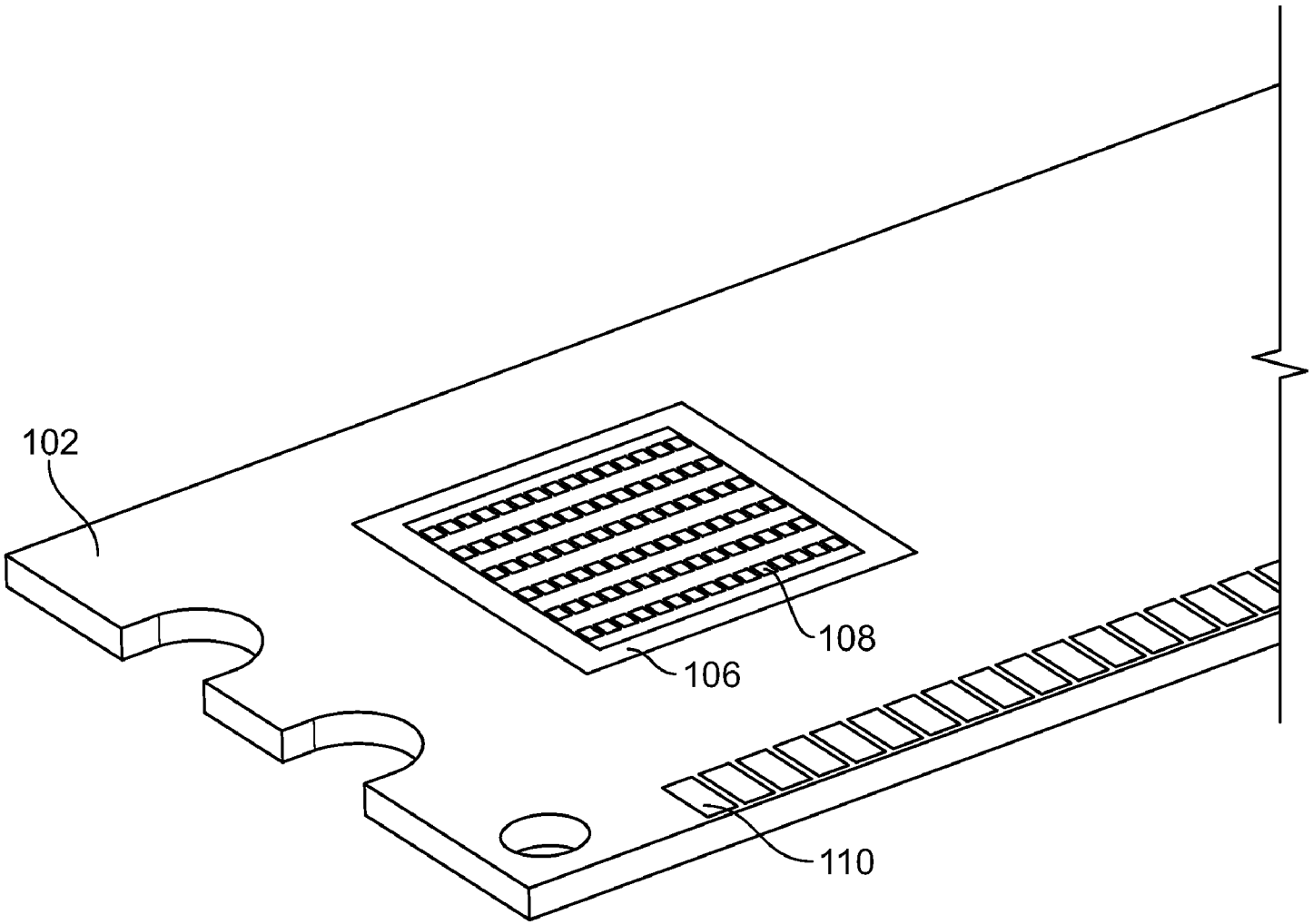
FIG. 11 is a perspective view of a circuit substrate and a mounting area for mounting the connector.

In FIG. 11, the mounting area of the circuit substrate 102 (PCB) for mounting the connector 114 is shown. It consists of an array of substrate contacts 108 and a solder area 106 for fixing the connector 114 by means of soldering the metal base 122.

Figure 12:
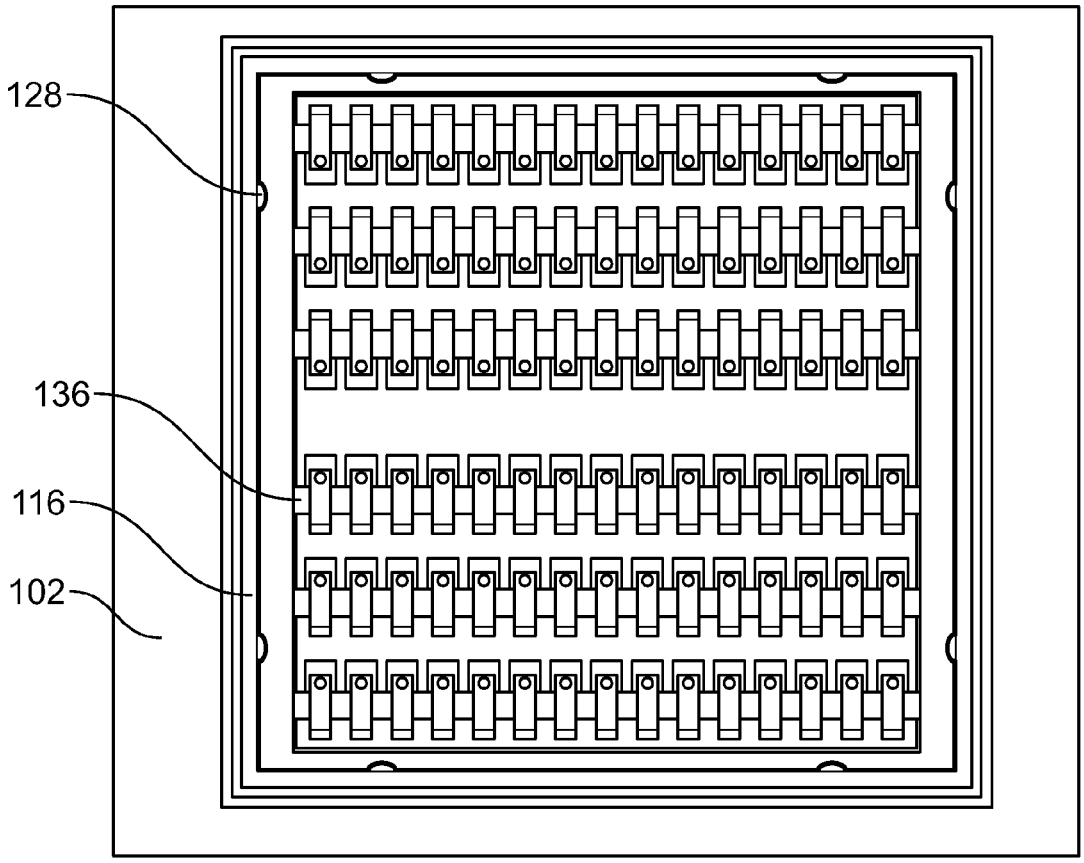
FIG. 12 is a top view of the circuit substrate after the connector of FIG. 9 is mounted.

FIG. 12 shows a top view of the connector 114 being soldered to the mounting area of the printed circuit board. In a next step, the SMD 112 can be assembled.

Figure 13:
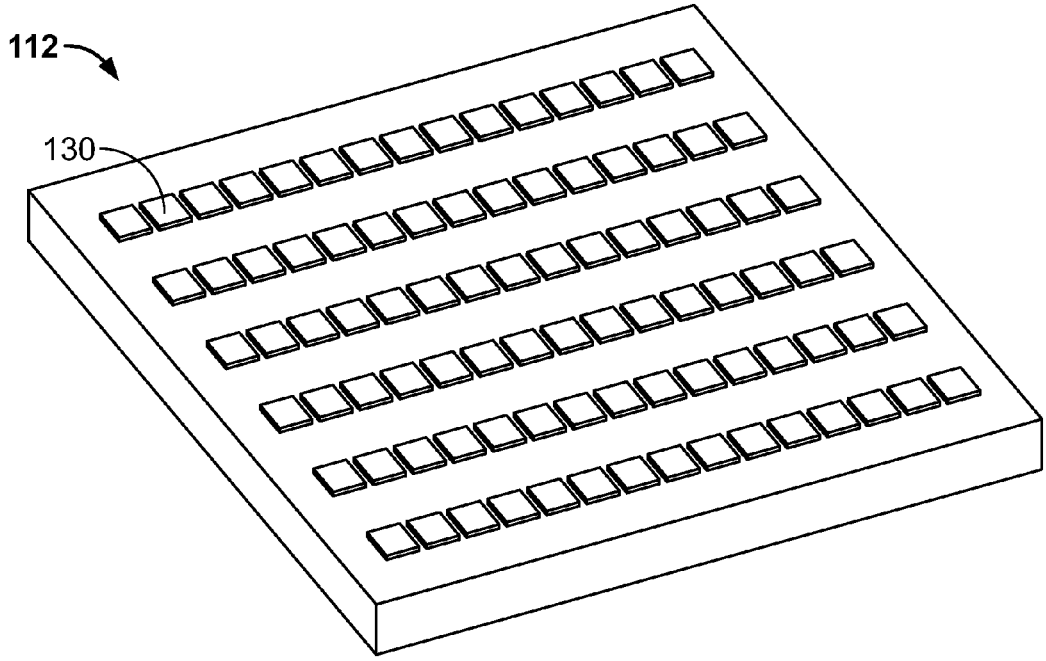
FIG. 13 is a perspective view of a rear surface of a surface-mount device.

As may be derived from FIG. 13, which shows the underside of the SMD 112, for instance, a die with a dimension of 10 mm×10 mm can be connected by the connector 114, according to the invention. It has six rows of fifteen terminals 130 at a pitch of 600 micrometers. As already mentioned, this array is produced by means of a redistribution layer.

Figure 14:
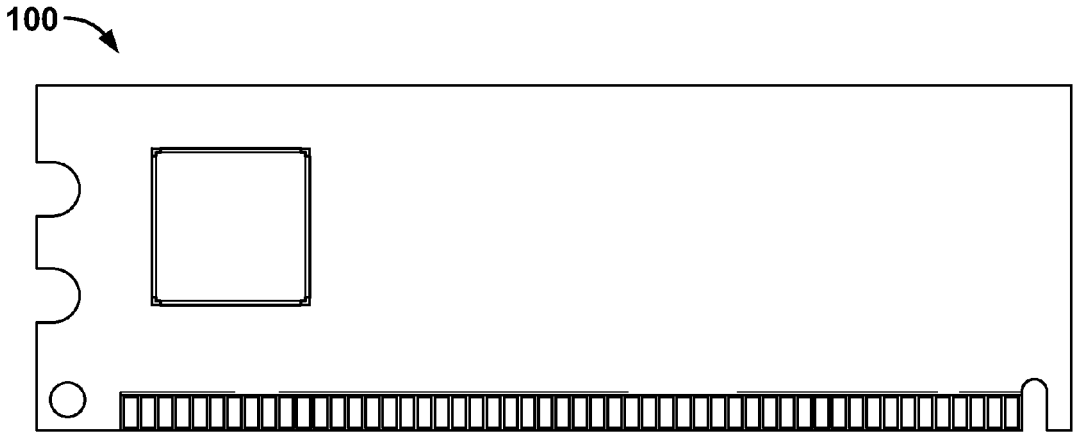
FIG. 14 is a perspective view of the electronic module completely assembled.

FIG. 14 finally shows the fully assembled electronic module 100 in a DIMM 184 Pin DDR 1.27 CLXX-1-format, according to JEDEC JC11 in full size.

Due to the cold interconnection technology used by the present invention, the integrated circuit can be assembled on the printed circuit board after a solder process step has been executed. In this way, the integrated circuits are not exposed to high temperatures and scrap rates due to such exposure can be decreased.

According to the present invention, a mechanical connector 114 is added between the integrated circuit and the printed circuit board. As set forth above, the connector 114 is fixed to the printed circuit board by means of a solder process, whereas the integrated circuit is mechanically assembled onto the connector 114 in a later process step. Therefore, the integrated circuit is not exposed to high temperatures. Providing a carrier, onto which the interconnection elements 118 are attached, allows a reproducible and cost-effective production of the connector 114 and also ensures a reliable and uniform electrical contact for all terminals 130 of the SMD 112.

In particular when electrically contacting a large array of terminals 130, the conductive interconnection elements 118 can be attached in a very precise way to the carrier 120 even by using fully automated reel-to-reel processes.

In order to allow for a certain freedom of movement in the assembled state, the interconnection elements 118 can be formed to be electrically contacted to the circuit substrate 102 through mechanical compression only.

Alternatively, when fabricating the interconnection element 118 in a way that it can be soldered to the substrate contact 108, a particularly secure connection to the circuit substrate 102 can be achieved. Furthermore, circuit substrate 102, i.e. printed circuit board, arrangements can be prefabricated, which only have to be fitted with the integrated circuit components in a subsequent solderless fabrication step.

When producing such the 126 cover from an electrically conductive material, such as metal or a metal-filled plastic material, a closed Faraday cage can be established for shielding the SMD 112 for electromagnetic interference.

Furthermore, the metal base 122 may be used during a solder process to fix the connector 114 to the circuit substrate 102 by means of the solder area 106 provided on the circuit substrate 102. Of course, other means for fixing the connector to a circuit substrate 102 are also possible. For instance, the connector 114 could be fixed by means of a snap-in connection, a glued connection, a further second overmold, a screw or riveting connection.

While the embodiments of the present invention have been illustrated in detail, it should be apparent that modifications and adaptations to those embodiments may occur. The scope of the invention is therefore limited only by the following claims.

What is claimed is:

1. A connector for electrically connecting a surface-mount device to a circuit substrate, comprising:

at least one resilient interconnection element being connectable with at least one substrate contact and configured to establish a releasable electrical contact with at least one terminal of the surface-mount device;

a connector housing for mounting the at least one interconnection element; and a foil-shaped carrier for connecting the interconnection element to the housing, wherein the foil-shaped carrier connects to the housing and a portion of the interconnection element such that the interconnection element is suspended within the housing.

2. The connector according to claim 1, wherein said interconnection element is connectable to the at least one substrate contact through a compressive connection.

3. The connector according to claim 1, wherein said interconnection element is connectable to the at least one substrate contact through a solder connection.

4. The connector according to claim 1, further comprising a frame configured to accommodate the surface-mount device.

5. The connector according to claim 4, wherein the frame includes a metal base.

6. The connector according to claim 1, further comprising alignment structures for aligning the surface-mount device with respect to the at least one interconnection element.

7. The connector according to claim 4, further comprising alignment structures for aligning the surface-mount device with respect to the at least one interconnection element.

8. The connector according to claim 1, wherein said foil-shaped carrier is made of elastic material.

9. The connector according claim 1, wherein the interconnection element is a U-shaped contact element having contact regions arranged at opposing legs of the U-shape.

10. The connector according claim 1, further comprising a cover for covering the surface-mount device and pressing it to the interconnection elements in an assembled state.

11. The connector according to claim 10, wherein the cover is metal.

12. The connector according claim 1, wherein a plurality of foil-shaped carriers having an array of interconnection elements are arranged within the housing.

13. A circuit board assembly for contacting at least one terminal arranged on a surface of a surface-mount device, comprising:

at least one substrate contact; and at least one connector for electrically connecting a surface-mount device to the circuit substrate, the connector having at least one resilient interconnection element, the interconnection element being connectable with at least one substrate contact and configured to establish a releasable electrical contact with at least one terminal of the surface-mount device, a connector housing for mounting the at least one interconnection element, and a foil-shaped carrier for connecting the interconnection element to the housing, wherein the foil-shaped carrier connects to the housing and a portion of the interconnection element such that the interconnection element is suspended within the housing.

14. The circuit board assembly according to claim 13, wherein the circuit substrate is a printed circuit board.

15. The circuit board assembly according to claim 13, wherein the circuit substrate has at least one mounting area for mounting the surface-mount device, the at least one substrate contact being arranged in the mounting area.

16. The circuit board assembly according to claim 15, wherein the mounting area has a fixing element for fixing the connector on the circuit substrate.

17. The circuit board assembly according to claim 16, wherein the fixing element includes a soldered connection.

18. The circuit board assembly according claim 13, wherein said at least one interconnection element is soldered to the substrate contact.

19. An electronic module comprising:

at least one surface-mount device with at least one terminal arranged on a surface of the surface-mount device;

a circuit substrate for mounting the surface-mount device, the circuit substrate having at least one substrate contact; and at least one connector for electrically connecting the surface-mount device to the circuit substrate, the connector having at least one resilient interconnection element being connectable with at least one substrate contact and configured to establish a releasable electrical contact with at least one terminal of the surface-mount device, a connector housing for mounting the at least one interconnection element, and a foil-shaped carrier for connecting the interconnection element to the housing, wherein the foil-shaped carrier connects to the housing and a portion of the interconnection element such that the interconnection element is suspended within the housing.

20. The electronic module according to claim 19, wherein the surface-mount device includes a silicon die having a redistribution layer, the at least one terminal of the surface-mount device being arranged on an outer surface of the redistribution layer.

21. A method for producing an electronic module having at least one surface-mount device and a circuit substrate for mounting the surface-mount device, comprising the steps of:

preparing the surface-mount device with at least one terminal arranged on a surface of the surface-mount device;

preparing the circuit substrate with at least one substrate contact;

preparing a connector having at least one electrically conductive interconnection element and a connector housing for mounting the at least one interconnection element;

connecting the at least one interconnection element to the at least one substrate contact;

mounting the at least one surface-mount device such that a releasable electrical contact is established to at least one terminal of the surface mount device;

wherein the interconnection element is affixed to the housing by means of a foil-shaped carrier, and wherein the foil-shaped carrier connects to the housing and a portion of the interconnection element such that the interconnection element is suspended within the housing.

22. The method according to claim 21, further comprising the steps of:

providing a metal frame to mount the at least one interconnection element to a housing; and conjoining the carrier with the frame using an overmold, the carrier bearing the at least one interconnection element.

23. The method according to one of the claim 21, further comprising the step of attaching a cover for covering the surface-mount device and pressing the at least one resilient interconnection element.

24. The method according to one of the claim 22, further comprising the step of attaching a cover for covering the surface-mount device and pressing the at least one resilient interconnection element.

* * * * *